US005787777A

United States Patent [19]

Ballestrazzi et al.

[11] Patent Number: 5,787,777

[45] Date of Patent: Aug. 4, 1998

[54] CUTTING DEVICE FOR TRIMMING PRINTED PAPER PACKAGES IN A PACKAGING MACHINE

[75] Inventors: Aris Ballestrazzi; Lamberto Tassi, both of Savignano Sul Panaro, Italy

[73] Assignee: SITMA, S.p.A., Modena, Italy

[21] Appl. No.: 746,292

[22] Filed: Nov. 7, 1996

[30] Foreign Application Priority Data

Dec. 5, 1995 [IT] Italy ..... MI950833 U

[51] Int. Cl.[6] ..... B26D 1/00

[52] U.S. Cl. ..... 83/100; 83/699.61; 83/695

[58] Field of Search ..... 83/99, 100, 653, 83/695, 694, 699.31, 699.41, 699.61

[56] References Cited

U.S. PATENT DOCUMENTS

| | | | |
|---|---|---|---|
| 2,387,876 | 10/1945 | Bright | 83/699.61 |
| 3,134,286 | 5/1964 | Judd | 83/699.41 X |
| 3,148,575 | 9/1964 | Thyng | 83/699.41 X |
| 3,574,039 | 4/1971 | Fehnr et al. | 156/515 |
| 3,765,990 | 10/1973 | Histed et al. | 156/515 |
| 3,793,919 | 2/1974 | Lefebvre | 83/694 X |
| 3,799,022 | 3/1974 | Nagel et al. | 83/694 X |
| 3,935,774 | 2/1976 | Craddy | 83/345 X |
| 4,037,501 | 7/1977 | Gladow | 83/346 X |
| 4,223,508 | 9/1980 | Wells | 53/138.4 |
| 4,344,610 | 8/1982 | Jeschke et al. | 83/101 X |
| 5,056,292 | 10/1991 | Natterer | 53/373.4 X |
| 5,127,292 | 7/1992 | Kapoor | 83/100 X |
| 5,439,550 | 8/1995 | Ballestrazzi et al. | 83/923 X |

FOREIGN PATENT DOCUMENTS

| | | |
|---|---|---|
| 680466 | 11/1966 | Belgium . |
| 1611773 | 1/1971 | German Dem. Rep. . |
| 2953538 | 2/1981 | German Dem. Rep. . |
| 550688 | 6/1974 | Switzerland . |

*Primary Examiner*—Maurina T. Rachuba

*Attorney, Agent, or Firm*—Oblon, Spivak, McClelland, Maier & Neustadt, P.C.

[57] ABSTRACT

A cutting device for trimming printed paper packages in a packaging machine. A cutting unit includes an upper part and a lower part which are movable relative to each other when a paper package passes between them. The package originates from paper material on a reel and is formed into a flat tube with glued edges with an unprinted neutral strip. One of the parts of the cutting unit carries two blades spaced apart by a distance equal to the width of the neutral strip and interacts with two counter blades on the other part. An elastic presser is positioned on one of the parts of the cutting unit to hold the package while the neutral strip is being cut by the blades. Spacers are provided so that the distance between the blades can be varied to match the width of the neutral strip.

12 Claims, 2 Drawing Sheets

CUTTING DEVICE FOR TRIMMING PRINTED PAPER PACKAGES IN A PACKAGING MACHINE

BACKGROUND OF THE INVENTION

1. Field of the Invention

This invention relates to a cutting device for trimming printed paper packages in a packaging machine.

2. Discussion of the Background

In the packaging of editorial products, promotional product sales communications, or generally in packaging into a paper wrapper closed along all its sides, reels of paper are used which are printed by rotary systems which reproduce, one after another, a plurality of print portions to be then located on a single final package.

In printing these reels by rotary systems, it is virtually impossible to print the plurality of print portions of a single package without leaving interspaces of neutral color between one printed region or image and the next. These interspaces are generated by the fixing region in which the plate on which the image of a single wrapper or a single package is reproduced is fixed to the printing cylinder. In this respect it should be noted that these interspaces are transverse to the paper reel, vary for example from 10 to 30 mm, are due precisely to the fixing system for said plate, and cannot in any way be minimized.

When the printed reel is unwound within the packaging machine and its lateral edges are superposed to form a flat tube, these interspaces remain as print interruption strips between one portion which will go to form one package and the next. After joining the superposed longitudinal edges of the continuous tube with glue or the like and positioning glue droplets or regions in proximity to these transverse strips towards the printed part, the individual packages are completely defined and are closed along all their sides and cut along the said neutral strips. Hence between one package and the next, ie at the two ends of each package once it is finished and separated, there remains an ugly strip or part of a strip of neutral color, which is unprinted because of the presence of said fixing region during printing. This neutral region exists at the end and at the beginning of the printed regions of an individual package.

SUMMARY OF THE INVENTION

An object of the present invention is to provide a device in a packaging machine which eliminates these strips or partial neutral regions in the finished package. A further object is to eliminate such strips even if their size on the printed paper reel varies.

BRIEF DESCRIPTION OF THE DRAWINGS

The characteristics and advantages of a cutting device for trimming printed paper packages in a packaging machine according to the present invention will be more apparent from the description given hereinafter by way of non-limiting example with reference to the accompanying schematic drawings, in which.

DISCUSSION OF THE PREFERRED EMBODIMENT

Figure 1:
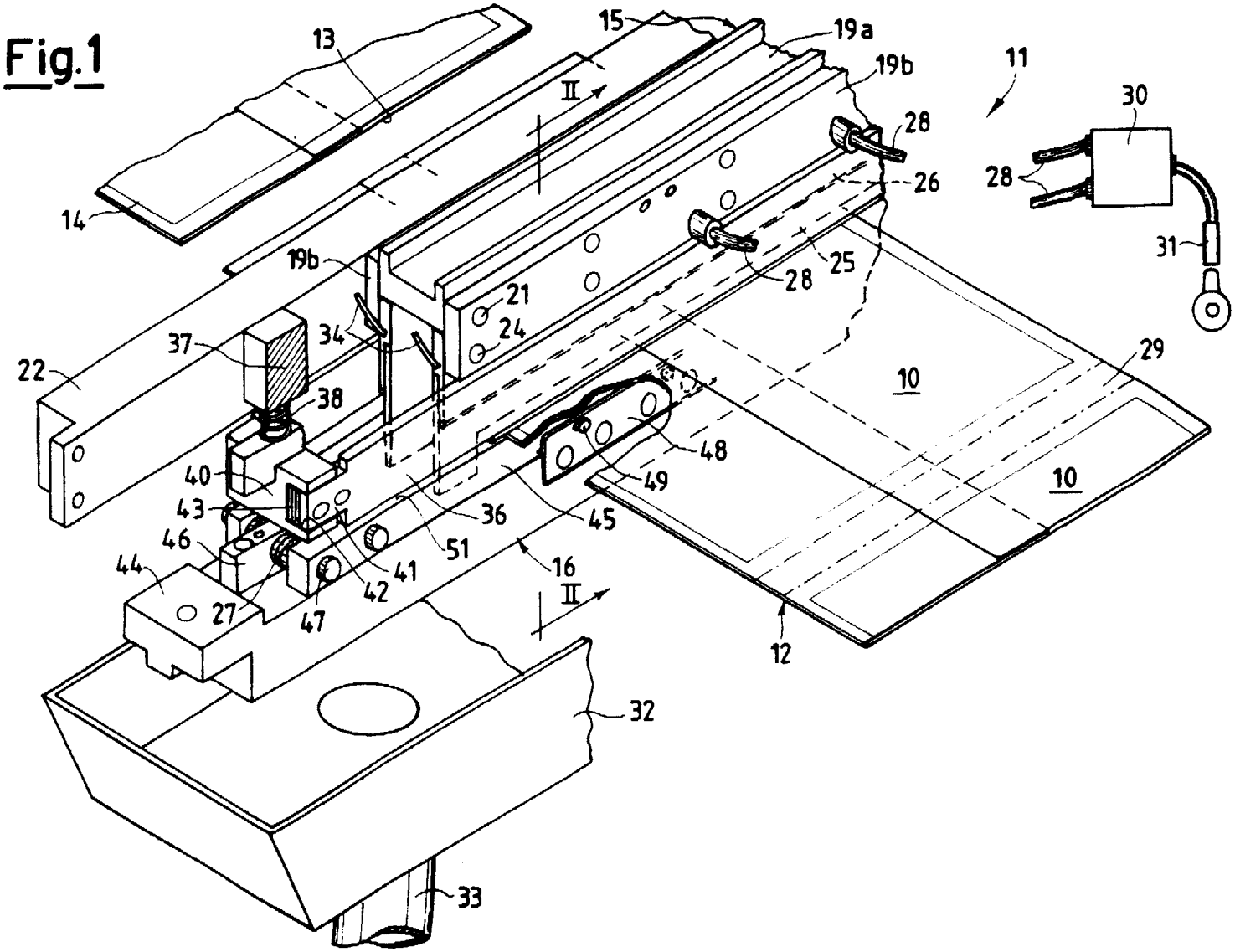
FIG. 1 is a perspective view of part of a cutting device for trimming printed paper packages applicable to a machine for packaging products into paper or the like according to the present invention, the remaining part being perfectly symmetrical.

With reference to the figures, a cutting device for trimming printed paper packages according to the present invention is shown in FIG. 1 and indicated overall by 11.

Figure 2:
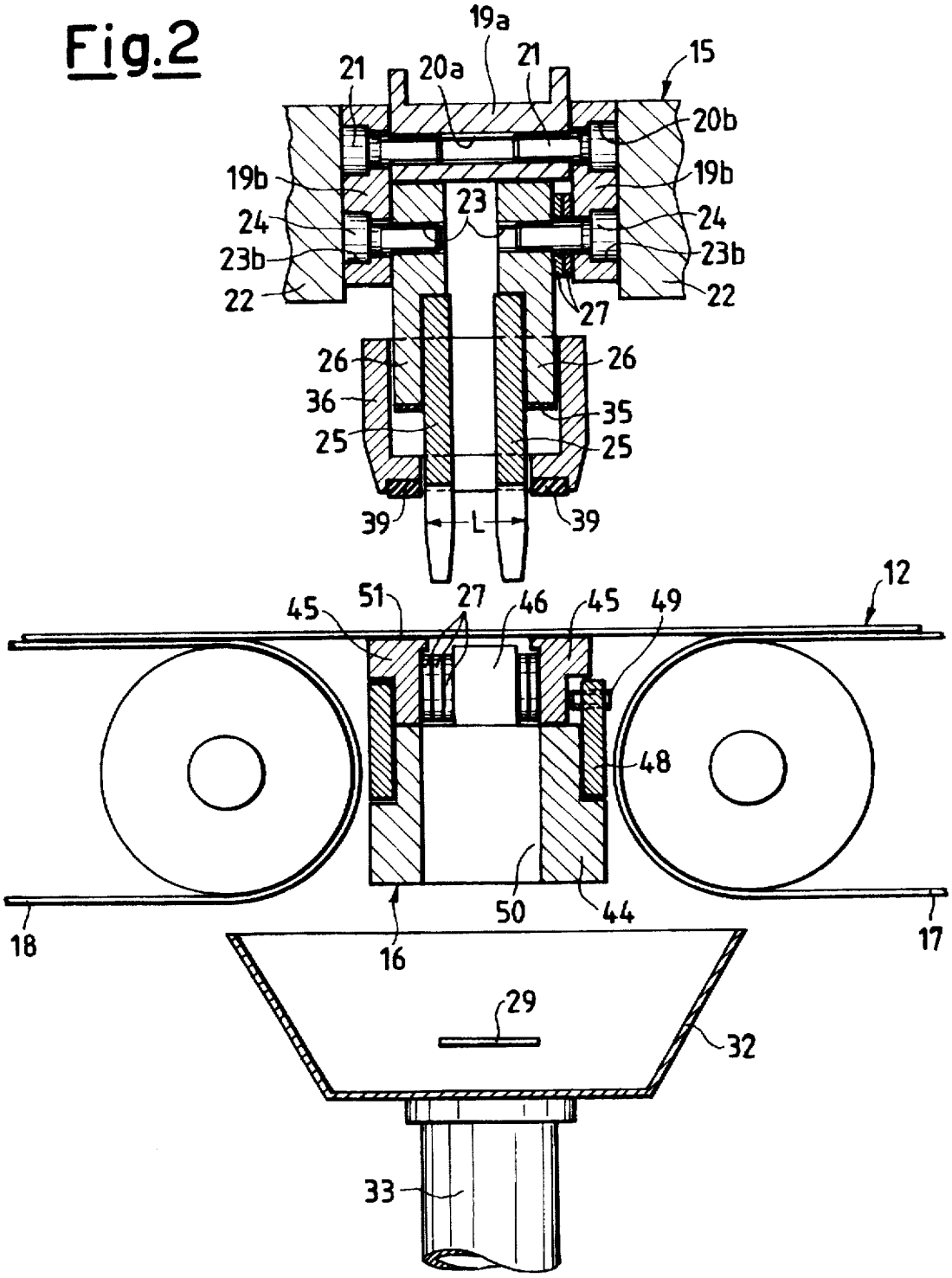
FIG. 2 is an at least partial enlarged elevation of the device of FIG. 1 in its open position.

A reel of paper or similar paper material is fed into a packaging machine (not shown). As stated above, this paper is folded on itself in a known manner, and is joined both along its superposed longitudinal edges by a longitudinal bonding unit (not shown) and along front and rear end transverse regions of the package so as to close it ready for use. In FIGS. 1 and 2 this paper material is shown already in its flattened tubular folded form at 12, provided with printed portions 10, before cutting. The reference numeral 13 in FIG. 1 indicates a rear end of a finished package 14.

Glue has already been applied in known manner along the longitudinal and transverse edges, both the continuous paper material 12 and the finished packages 14 being advanced by conveyors 17 and 18 positioned upstream and downstream of the invention 11, as shown in FIG. 2.

The device of the invention 11 comprises essentially an upper part, indicated overall by 15 in FIG. 2, and a lower part indicated by 16. it should be noted that this device is located in a packaging machine instead of and in the same position as a traditional transverse cutting and/or bonding unit.

The upper part 15 of the device consists of a cutting unit composed of a support structure including a central portion **19*a* and two lateral portions 19*b*, for example constructed of high-strength aluminium in three parts joined together by screws. In its two lateral portions 19*b* this support structure comprises a series of through holes 20*b* to receive screws 21 to be screwed into threaded holes 20*a* in a central portion 19*a* positioned between the two lateral portions 19*b*. The lateral portions 19*b* are joined (by elements not shown) to a movable support 22 on the packaging machine, which can move vertically upwards and downwards. It will be noted that advantageously the movable support 22 is that which usually forms the support for a common cutting and bonding device in traditional packaging machines . A further series of through holes 23*b* provided in the lateral portion 19*b* of the support structure allows cutting blades 25, located on relative connectors or supports 26 also provided with holes 23, to be positioned and fixed by screws 24**.

The position of the connectors 26 relative to the lateral portions **19*b* can be adjusted and differentiated by providing freely removable space elements in the form of sized spacers 27, such as washers, insertable into an interposed position at the time of positioning the screws 24** to join the parts together. The cutting width L can hence be varied.

Compressed air hoses 28 for feeding air into the cutting unit, i.e into the cutting blades 25, are connected to at least one of the lateral portions **19*b* of the support structure of the upper part 15. The fed compressed air is used to expel a strip 29, i.e a trimmed piece, which is defined at the moment of forming the final package. This neutral strip 29 represents an interspace between the printed portions 10 of the continuous tubular paper material 12**.

The compressed air feed is activated by a solenoid valve indicated schematically at 30 controlled by a microswitch with relative operating cam, both indicated by 31, which enables an air blast to be fed in for a few moments, only when the strip 29 has been completely cut off. The strip 29 falls and is drawn into an underlying tray 32 provided with a suction pipe, partially shown at 33, to collect the scrap trimmed elements 29. This tray can be positioned rigidly with the packaging machine structure below the lower part 16 of the device.

The connectors or supports 26 are provided with internal ducts connected to conduits 34 for the passage of grease or a similar lubricant for guiding the cutting blades 25. The lubricant is pumped in small quantities, at selected times and in selected quantities, from a reservoir (not shown) to which the conduits 34 are connected.

Rubber strips 35 are applied to the lower end surfaces of the connectors or supports 26 to dampen the contact with spring presser elements 36 described hereinafter.

In this respect, the spring presser elements 36 are suspended from and fixed to extensions 37 positioned at opposite ends of the movable support 22 (only one of which is shown)in FIG. 1. The presser elements 36, the purpose of which is to lock the continuous paper material 12 during the cutting and removal of the strip or trimmed element 29, also act to press points or regions of glue previously applied transverse to the interior of the flat tubular material 12 to define transverse seals for the finished package 14.

As will be apparent hereinafter, the presser elements 36 are retained in a manner movable relative to the extensions 37 by springs 38. The presser elements 36 descend simultaneously with the upper part 15 of the device, or of the cutting unit, and firstly intercept the flat tubular material 12 to lock it by means of rubber strips 39 fixed to their lower surfaces. The rubber strips 39 act as elements which prevent slippage of the paper material 12 during cutting and removal of the strip or trimmed element 29.

As shown in FIG. 1 , for their support and assembly the presser elements 36 are connected together at their ends by crosspieces 40 to which the springs 38 are connected. The spring are also connected to the extensions 37 of the movable support 22. The presser elements 36, being two in number and positioned on opposite sides of the two blades 25, have their ends 41 housed in seats 42 in the crosspieces 40. Sized spacers 43 can be inserted into said seats 42, to be added or removed to an equal extent on both sides of the crosspieces 40 to maintain perfect parallelism and contact with the upper part 15 of the device on which the presser elements 36 cooperating with the cutting unit are mounted.

A lower support structure 44, for example of aluminium, is provided on which there are mounted counter-cutting blades 45, for example of hardened steel, as in the case of the said upper cutting blades 25. The blades 45 are spaced apart at the same cutting distance L as blades 25.

In this respect, on the lower support 44 there are fixed two central bars 46, positioned at opposite ends (only one is shown on the drawing), and to which the counter-cutting blades 45 are rigidly fixed by screws 47 passing through holes (not shown) in the counter-cutting blades 45 and screwed into the two central bars 456. Sized spacers identical to those previously indicated by 27 in the upper cutting unit can be interposed between the two central bars 46 and the counter-cutting blade 45.

A further plate 48, located rigidly with the lower support 4 external to the counter-cutting, blades 45 is used as the adjustment member. In this respect, by means of setscrews or similar elements 49, the position of the counter-cutting blades 45 can be adjusted micrometrically to determine correct friction between the upper blades 25 and the lower counter-blades 45 of the entire cutting unit.

It will be noted that a passage is defined between the two counter-blades 45 and by a slot 5 provided in the lower support 44, for the fall of the strips or trim elements 29 which in this manner can reach the underlying tray 32. A smooth upper surface part 51 of the counter-blades 45 acts as a counter-presser element, on which the rubber strips 39, act and abut to retain the paper material 12. The operation is clear from the aforegoing description, but is briefly as follows. The packaging machine provided with the device of the present invention is arranged as shown in the example, to remove neutral strips 29 of the size shown. In this manner as the paper material 12 advances and assumes the required tubular shape, packages are formed containing further editorial or different elements. These packages are formed by the application and distribution of glue in known preceding stages.

The individual packages must now be separated by eliminating the neutral strip 29, or at least that part thereof which it is desired to eliminate, in order to form the finished package. The device of the present invention is used to achieve this.

The cutting action on the continuous paper material 12 in the region of the neutral strip 29 is determined by a system for very accurately setting the print pitch, for example using suitable cells and print sensors provided in the machine, which determines correct stepwise unwinding of the paper, and actuators (not shown) synchronized with the correct unwinding and determining the raising and lowering of the upper part 15 of the cutting unit.

In this manner, the movable support 22 and the presser elements 36 which locks the paper material 12 on the smooth part 51 of the upper surface of the counter-blades 45 on the opposite sides of the neutral strip 29 are made to descend, followed immediately afterwards by the blades 25. The blades 25 interact with the counter-blades 45 to cut off the neutral strip 29.

Air is then fed in by the action of the cam microswitch 31 and the solenoid valve 30, this air blown between the blades 25 causing the separated strip 29 to fall into the underlying tray 32, which is in a state of suction by virtue of the suction pipe 33. The package 14 is hence ready and trimmed as required to the cutting width L desired by the user.

If after this packaging operation a new reel of paper material 12 is to be used having its neutral strips 29 between one printed portion and the next of a different width, for example greater than the preceding, the cutting width L has to be changed, this being easily achieved as follows.

By operating the screws 24, a number of sized spacers 27 can be removed from the upper part 15 of the bonding unit to widen the distance between the blades 25 as required. The sized spacers 27 removed from the upper part 15 are mounted on the removed screws 47 of the lower part 16, to widen the distance between the counter blades 45 to an equal extent.

To achieve complete adaptation of the entire device it may be necessary to insert sized spacers 43 to an equal extent between the upper presser elements 36 and their seats 42. The device is hence adapted to the new width of the neutral strip 29, generally corresponding to the trimmed piece, in an extremely simple and rapid manner. If the strip is of lesser width than that previously trimmed, then the adaptation would be in the opposite manner.

All this is achieved with a single device, using the same blades and counter-blades and the same supports without having to replace any parts, so eliminating down times for adapting and replacing interacting operational parts.

Using a device of the present invention it is hence possible to trim neutral strips of width from about 12 to 27 mm with the same device, by merely shifting the spacers. This enables already existing print cylinders to be used having their diameter and lateral surface not perfectly correlated with the length of the printed part of the desired final package. Hence a type of offset printing is achieved which is less costly and faster to use.

The presence of the further plate 48 allows the interaction between the cutting blades and counter-blades to be micrometrically adjusted at any moment.

The underlying suction enables the strips or trimmed portions 29 to be evacuated without their obstructing the packaging machine. For trimming a minimum width, the blade and counter-blade could be in the form of a pair of adjacent blades representing the sides of a single closed-perimeter hollow punch blade, interacting with a counter-blade of the same form. In this case no adjustment of the relative position of the parallel blades is required, as they are positioned a fixed distance apart. In this manner a continuous printed material with a fixed-size strip to be trimmed can be handled.

We claim:

1. A cutting device for trimming neutral strips from printed paper packages in a packaging machine, said cutting device comprising:

an upper part and a lower part which move upwards and downwards relative to each other, between which are slidingly supported said printed paper packages with neutral strips;

one of said upper part and lower part including a structure for carrying two blades;

an other of said upper part and lower part including two counter-blades;

wherein said two blades and said two counter-blades act together to cut said printed paper package;

one of said upper part and said lower part further including elastic presser elements for locking said printed paper package while it is being cut;

said elastic presser elements being connected by springs to a support for said structure; and spacer elements, which are freely removable, being mounted in said upper part and said lower part to vary the distance between said two blades and said two counter-blades so that a width of the printed paper package which is cut may be varied so that only the neutral strip is cut from said printed paper packages.

2. A device as claimed in claim 1, wherein said upper part moves upwardly and downwardly.

3. A device as claimed in claim 1 or 2, wherein additional spacer elements vary a distance between said elastic presser elements.

4. A device as claimed in claim 1, further comprising a vacuum device provided below said lower part for receiving said neutral strips cut from said printed paper packages.

5. A device as claimed in claim 4, wherein said vacuum device includes a tray connected to a vacuum pipe.

6. A device as claimed in claim 1, wherein said presser elements include rubber strips fixed to lower surfaces of said presser elements to prevent slippage of said printed paper packages.

7. A device as claimed in claim 1, further comprising relative connectors for supporting said two cutting blades and being provided with holes for positioning relative to said lateral portions, wherein said spacer elements are interposed between said relative connectors and said lateral portions.

8. A device as claimed in claim 1 or 7, wherein said spacer elements are sized spacers.

9. A device as claimed in claim 8, wherein said spacer elements are washers interposed on positioning screws which fix said relative connectors and said lateral portions to said support.

10. A device as claimed in claim 1, further comprising adjustment means for adjusting a position of said two counter-blades relative to said two blades.

11. A device as claimed in claim 10, wherein said adjustment means include a plate rigidly mounted on a support for said counter-blades and a set screw which is screwed into said plate and acts against said counter-blades to adjust a distance between said two counter-blades.

12. A device as claimed in claim 1, further comprising hoses connected to a source of pressurized air and to said support for supplying air to a space between said blades to expel said neutral strip when cut from said printed paper package.

* * * * *